US007698879B1

(12) United States Patent
Mrasek et al.

(10) Patent No.: US 7,698,879 B1
(45) Date of Patent: Apr. 20, 2010

(54) INSERTER AND METHOD

(75) Inventors: Anthony Mrasek, Mississauga (CA); Carlo Giammarco, Mississauga (CA); Jitender Singh, Mississauga (CA); Stavros Steven Michalopulo, Mississauga (CA)

(73) Assignee: Patheon Inc., Mississauga, Ontario (CA)

( * ) Notice: Subject to any disclaimer, the term of this patent is extended or adjusted under 35 U.S.C. 154(b) by 5 days.

(21) Appl. No.: 12/245,877

(22) Filed: Oct. 6, 2008

(51) Int. Cl.
*B65B 5/00* (2006.01)

(52) U.S. Cl. ..... 53/473; 53/248; 53/249; 53/252

(58) Field of Classification Search ..... 53/473, 53/474, 475, 235, 249, 250, 252, 248
See application file for complete search history.

(56) References Cited

U.S. PATENT DOCUMENTS

| | | | | | |
|---|---|---|---|---|---|
| 4,237,674 | A * | 12/1980 | Aykut | 53/249 |
| 4,373,711 | A | 2/1983 | Foster et al. | |
| 4,449,351 | A | 5/1984 | Henderson | |
| 4,501,417 | A | 2/1985 | Foster et al. | |
| 4,586,315 | A * | 5/1986 | Wolf | 53/447 |
| 5,081,816 | A | 1/1992 | Cardinali | |
| 5,155,981 | A * | 10/1992 | Tordini | 53/559 |
| 5,177,936 | A * | 1/1993 | Myers et al. | 53/467 |
| 5,236,076 | A * | 8/1993 | Sung | 198/368 |
| 5,323,587 | A * | 6/1994 | Amaranti | 53/155 |
| 5,454,206 | A * | 10/1995 | Bailer et al. | 53/157 |
| 6,289,658 | B1 * | 9/2001 | Sting et al. | 53/569 |
| 6,318,051 | B1 | 11/2001 | Preiss | |
| 6,339,910 | B1 * | 1/2002 | Hahnel et al. | 53/258 |
| 6,637,174 | B1 * | 10/2003 | Dietrich et al. | 53/252 |
| 6,964,150 | B2 | 11/2005 | Battisti | |
| 7,051,495 | B2 | 5/2006 | Lang et al. | |
| 7,188,459 | B2 | 3/2007 | Brauneis et al. | |
| 2008/0184670 | A1 * | 8/2008 | Grabowski et al. | 53/252 |

* cited by examiner

*Primary Examiner*—Paul R Durand

(57) ABSTRACT

An insert with an upwardly projecting protuberance proximate one end is inserted into an open container. The open container is conveyed continuously in a downstream direction with a container conveyor with the container opening upwardly. The insert is held above the conveyor at an insertion station by supporting a downstream portion of the insert: the protuberance bearing end of the insert being the upstream end of the insert. A pusher finger is driven downwardly against an upstream portion of the insert at a downstream side of the protuberance in order to push the upstream portion of the insert downwardly into the container. The upstream portion of the insert is pushed against an inside surface of the container with the pusher finger while the container is conveyed underneath the insert. Simultaneously, the support is removed from the downstream portion of the insert. With the pusher finger abutting the downstream side of the protuberance, frictional engagement between the insert and the container is overcome as the container is conveyed underneath the insert. The pusher finger is retracted at the conclusion of the insertion operation.

13 Claims, 10 Drawing Sheets

INSERTER AND METHOD

BACKGROUND

This invention relates to an inserter and a method of inserting inserts into containers.

A blister pack in which pharmaceutical tablets or other small articles are packaged typically comprises a blister sheet of clear plastic with each blister containing one or more of the tablets. A frangible foil sheet is attached to the blister sheet so that the tablets may be dispensed from the blister pack by pushing them through the foil sheet. A typical blister pack 20 with blisters 23 is shown in FIG. 1. Such a blister pack is sufficiently rigid so that it is self-supporting.

A blister pack may be housed in a blister compact with the foil sheet against the inner bottom surface of the container portion of the compact. The container has discharge openings which align with the blisters so that the tablets can be pushed through the discharge opening to be dispensed. A typical blister compact 22 is shown in FIG. 1. The blister compact 22 has a cover 24 and a container 26 made of a plastic material and connected to one another along a living hinge 28 which biases the cover 24 and the container 26 toward an open position. The container 26 has a series of discharge openings 25. The spacing and size of the discharge opening 25 in the container 26 are such that, when the blister pack 20 is placed within the blister compact 22, each blister 23 of the blister pack 20 overlies a corresponding discharge opening 25 in the container 26. Consequently, when the cover 24 is open, a user can dispense a tablet by simply pressing on the corresponding blister 23 and displacing the tablet through the foil sheet of the blister pack 20 and through the corresponding discharge opening 25 in the container 26.

The blister compact 22 may have tabs 27 which hold the blister pack 20 inside the blister compact 22 when the outside edges of the blister pack 20 are inserted underneath the tabs 27.

It is known to insert blister packs manually into blister compacts. This, however, is a relatively slow and expensive approach.

SUMMARY OF THE INVENTION

According to the present invention, there is provided a method of inserting an insert having an upwardly projecting protuberance proximate one end into an open container comprising: conveying said open container continuously in a downstream direction with a container conveyor with said container opening upwardly; holding said insert above said conveyor at an insertion station by supporting a downstream portion of said insert, with said one end of said insert being the upstream end of said insert; driving a pusher finger downwardly against an upstream portion of said insert at a downstream side of said protuberance in order to push said upstream portion of said insert downwardly into said container; holding said upstream portion of said insert against an inside surface of said container with said pusher finger while said container is conveyed underneath said insert and simultaneously ceasing to support said downstream portion of said insert, said pusher finger abutting said downstream side of said protuberance to overcome frictional engagement between said insert and said container as said container is conveyed underneath said insert; and retracting said pusher finger.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In the figures, which illustrate an example embodiment of the invention.

DETAILED DESCRIPTION OF THE PREFERRED EMBODIMENTS

Figure 1:
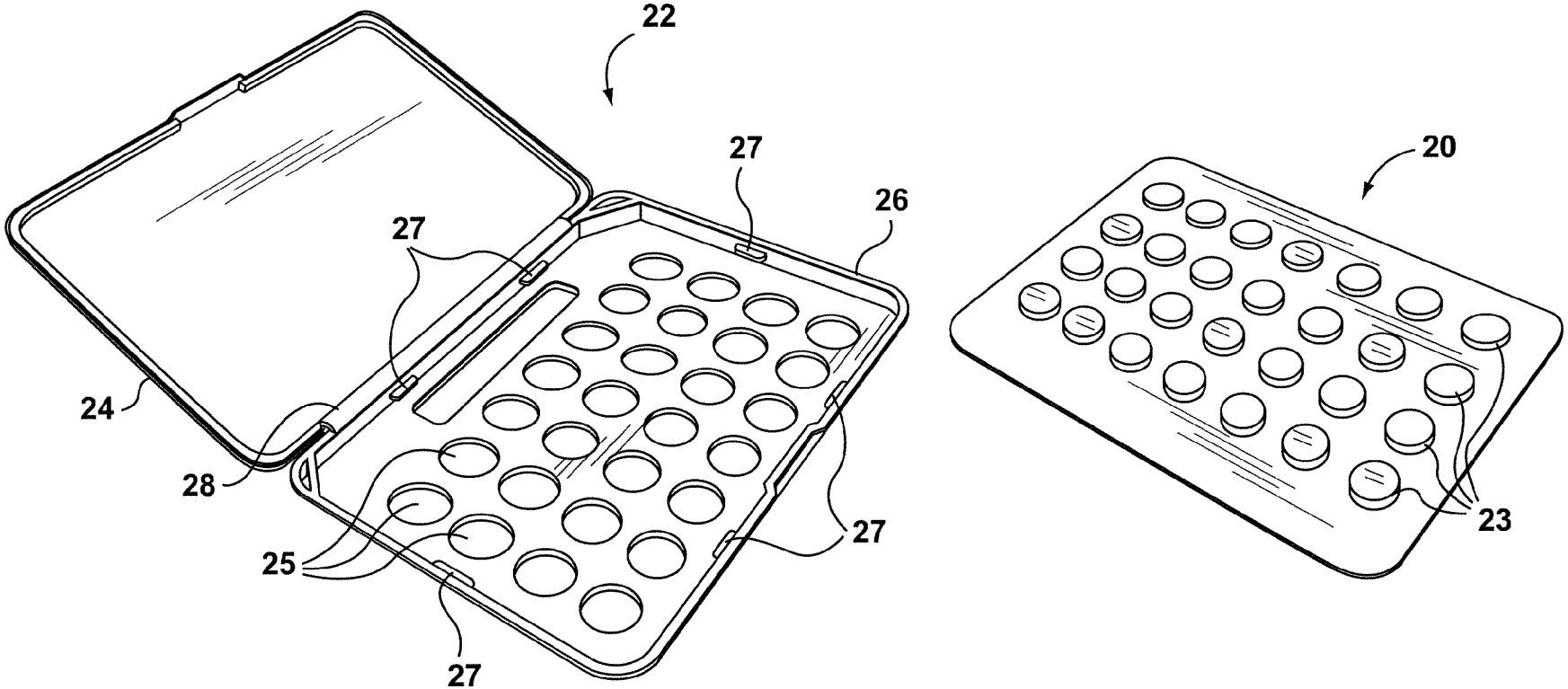
FIG. 1 (Prior Art)
FIG. 1 is a perspective view of a known blister pack and a known blister compact.
Figure 2:
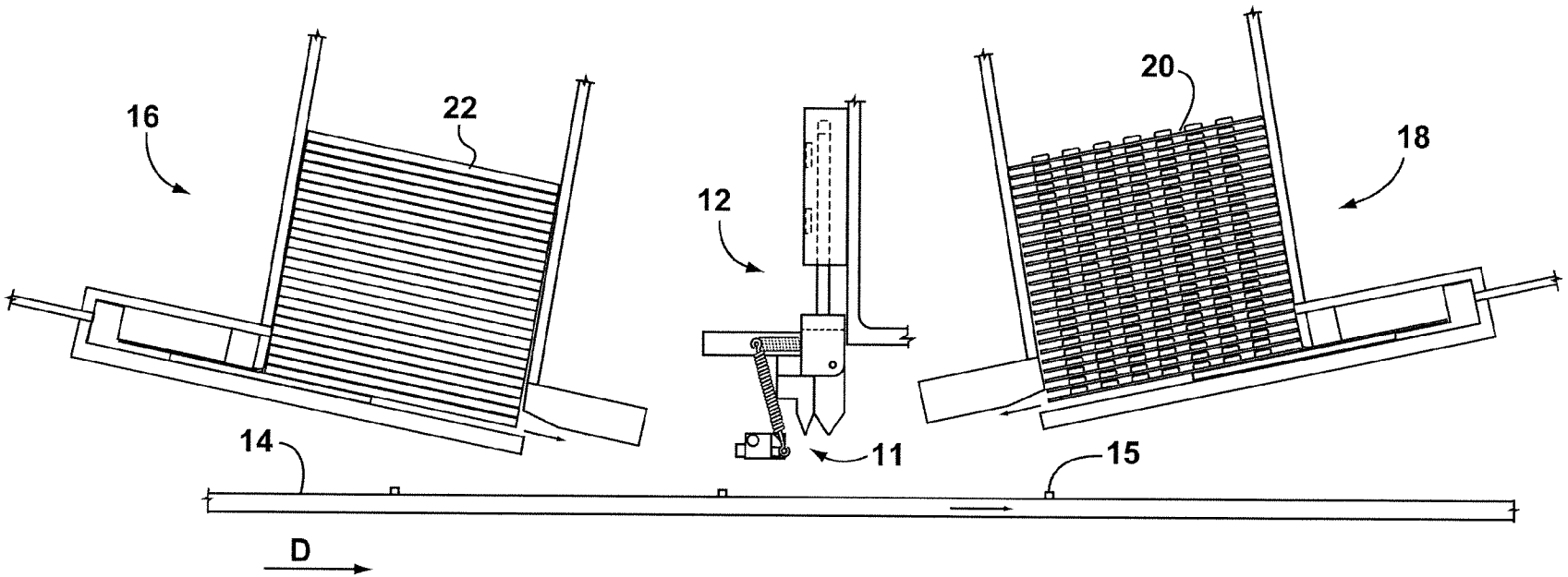
FIG. 2 is a partially fragmented side view of an apparatus embodying the present invention.

Referring to FIGS. 1 and 2, apparatus 10 for inserting inserts, such as blister packs 20, into containers, such as blister compacts 22, includes a container conveyor 14 with a container feeder 16, an insert feeder 18, and an inserter 12 at an insertion station 11 overlying the conveyor 14. The conveyor 14 has an upper conveying surface with crosspieces 15 forming flights therebetween with each flight designed to receive a compact 22. The conveyor 14 is designed to continuously convey the compacts 22 in a downstream direction D.

Figure 3:
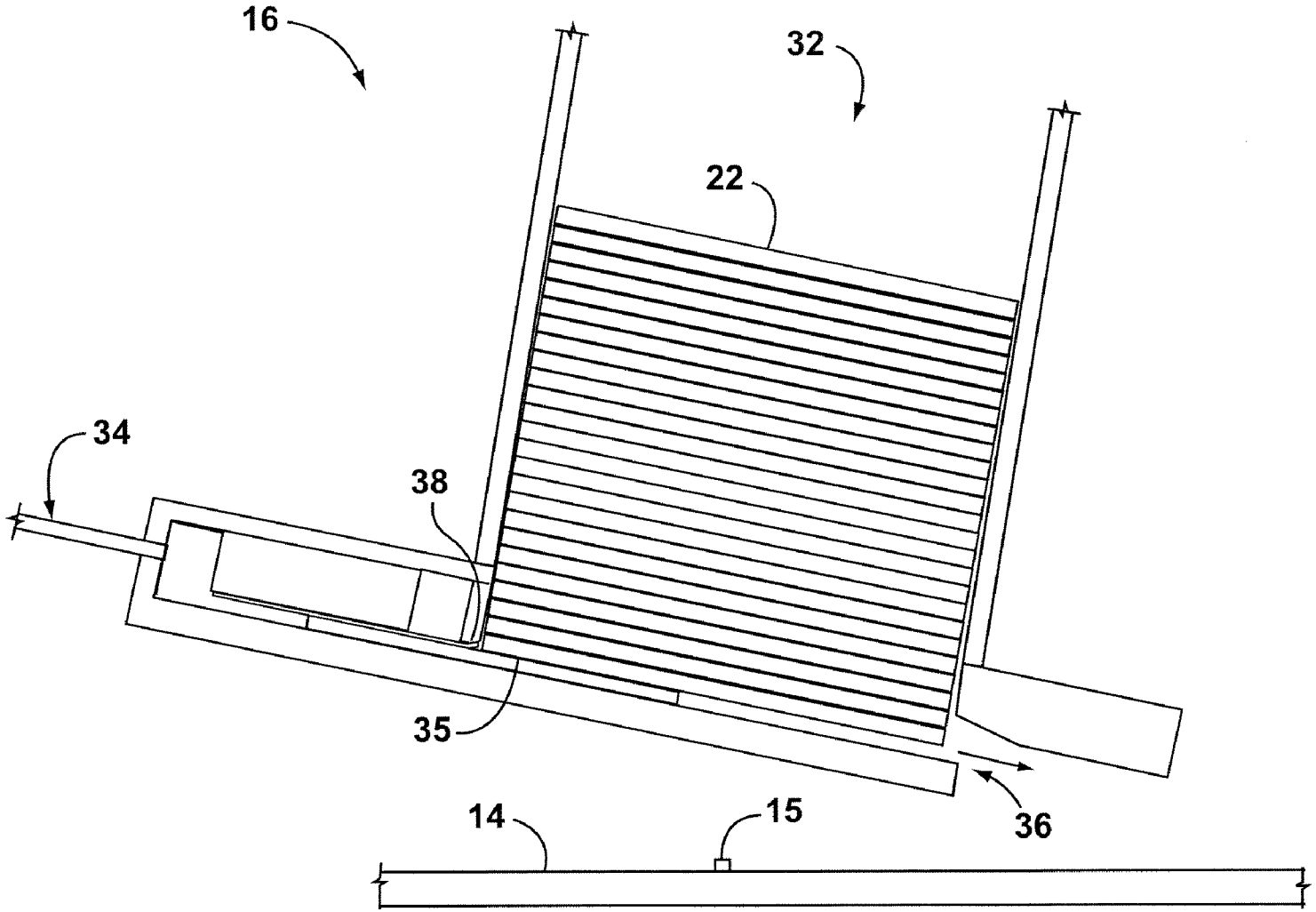
FIGS. 3 to 5 are enlarged views of different portions of the apparatus of FIG. 2.

Referring to FIG. 3, the container feeder 16 has a hopper 32 containing a stack of open, upwardly opening, compacts 22. A pusher 34 is located at the base of the hopper 32 opposite a dispensing slot 36 for pushing the bottommost compact 22' out of the hopper 32.

Figure 4:
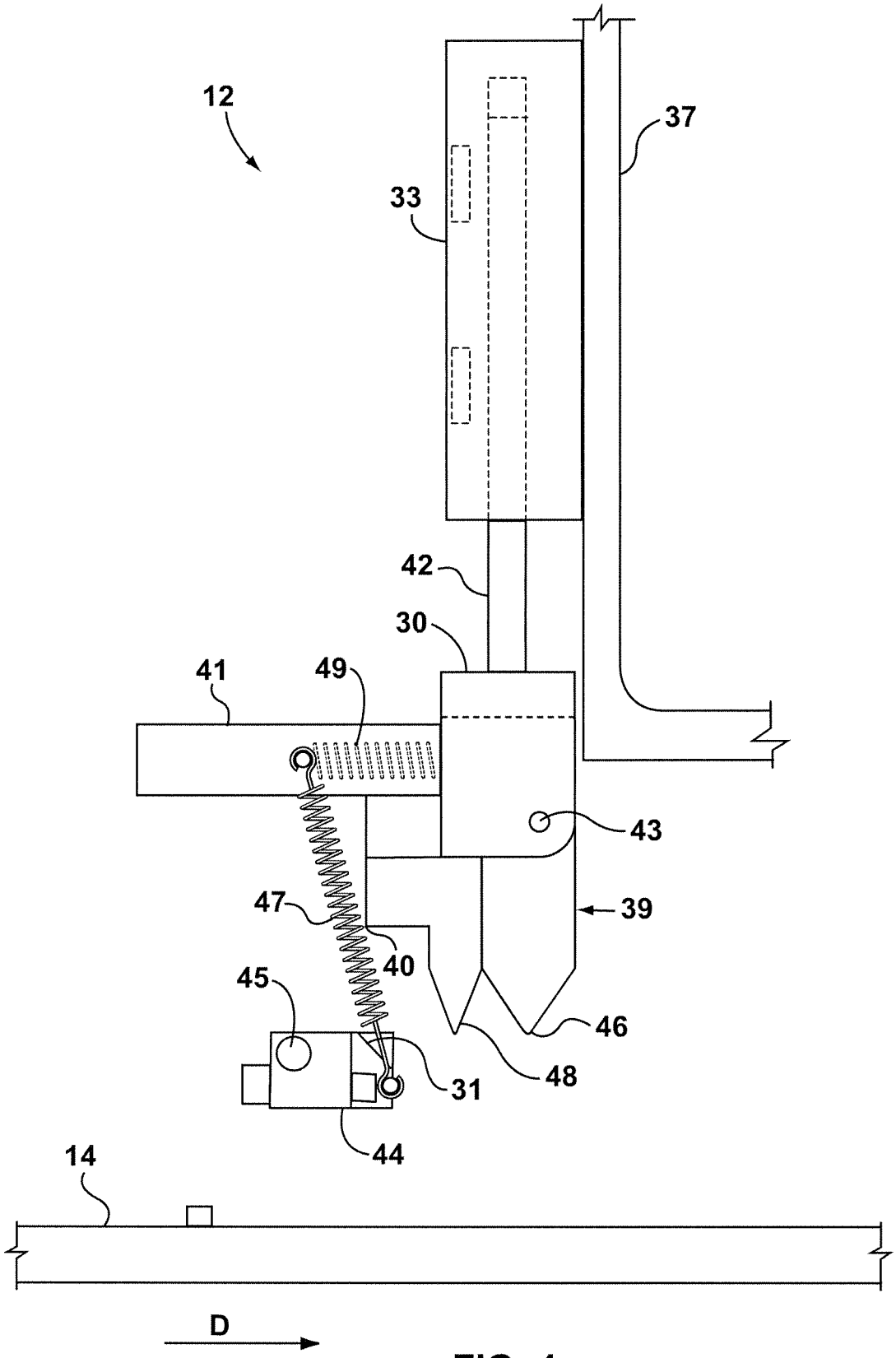

Referring to FIG. 4, the inserter 12 has a piston 42 extending from a hydraulic cylinder 33 supported by mount 37. A block 39 with a pair of fingers 46, 48 is pivotably mounted at pivot 43 to the head 30 of the piston 42. A compression spring 49 abuts one side of the block 39 and is backstopped by an inner wall of an extension 41 of the piston head 30. The compression spring 49 urges the block 39 to rotate in a clockwise direction to a home position (illustrated in FIG. 4) whereat the fingers 46, 48 project vertically downwardly. For reasons which will become apparent hereinafter, downstream finger 46 acts as a pusher finger and upstream finger 48 as a guide finger. Further, the upstream corner of guide finger 48 acts as an abutment 40.

A catch member 44 is pivotably supported on a pivot 45 above the conveyor 14. A tension spring 47 is attached at one end to the catch member 44 and at its opposite end to the pivot head extension 41. The tension spring 47 urges the catch member 44 to a catch position illustrated in FIG. 4. The catch member 44 has an angled cam face 31 directly below abutment 40.

Figure 5:
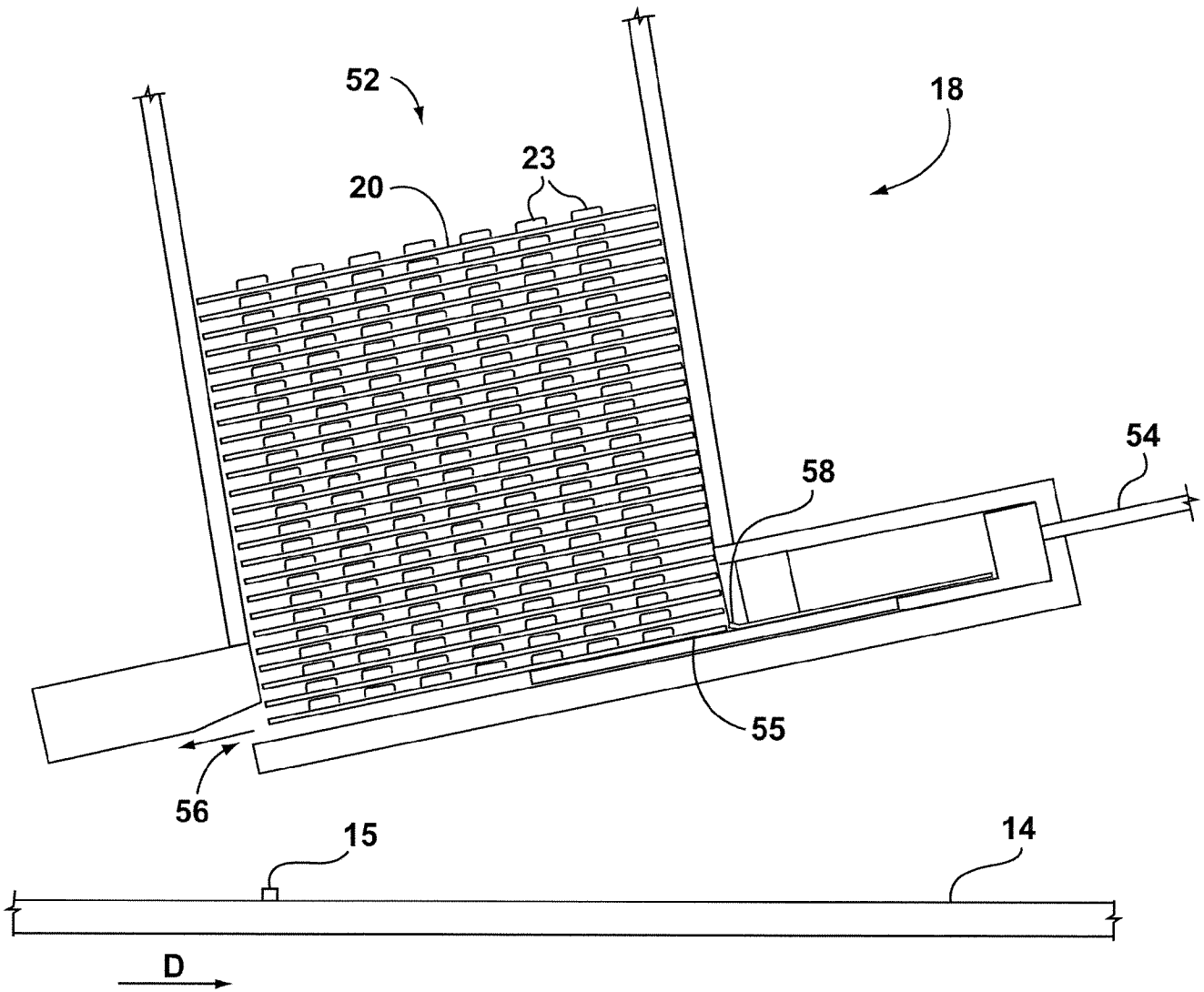

Referring to FIG. 5, the insert feeder 18 has a hopper 52 containing a stack of blister packs 20. The blister packs 20 are stacked with blisters 23 facing upwards. A pusher 54 is located at the base of the hopper 52 opposite a dispensing slot 56 for pushing the bottommost blister pack 20' out of the hopper 52. The pusher 54 terminates in a support platform 55 with an upturned finger 58.

Figure 6:
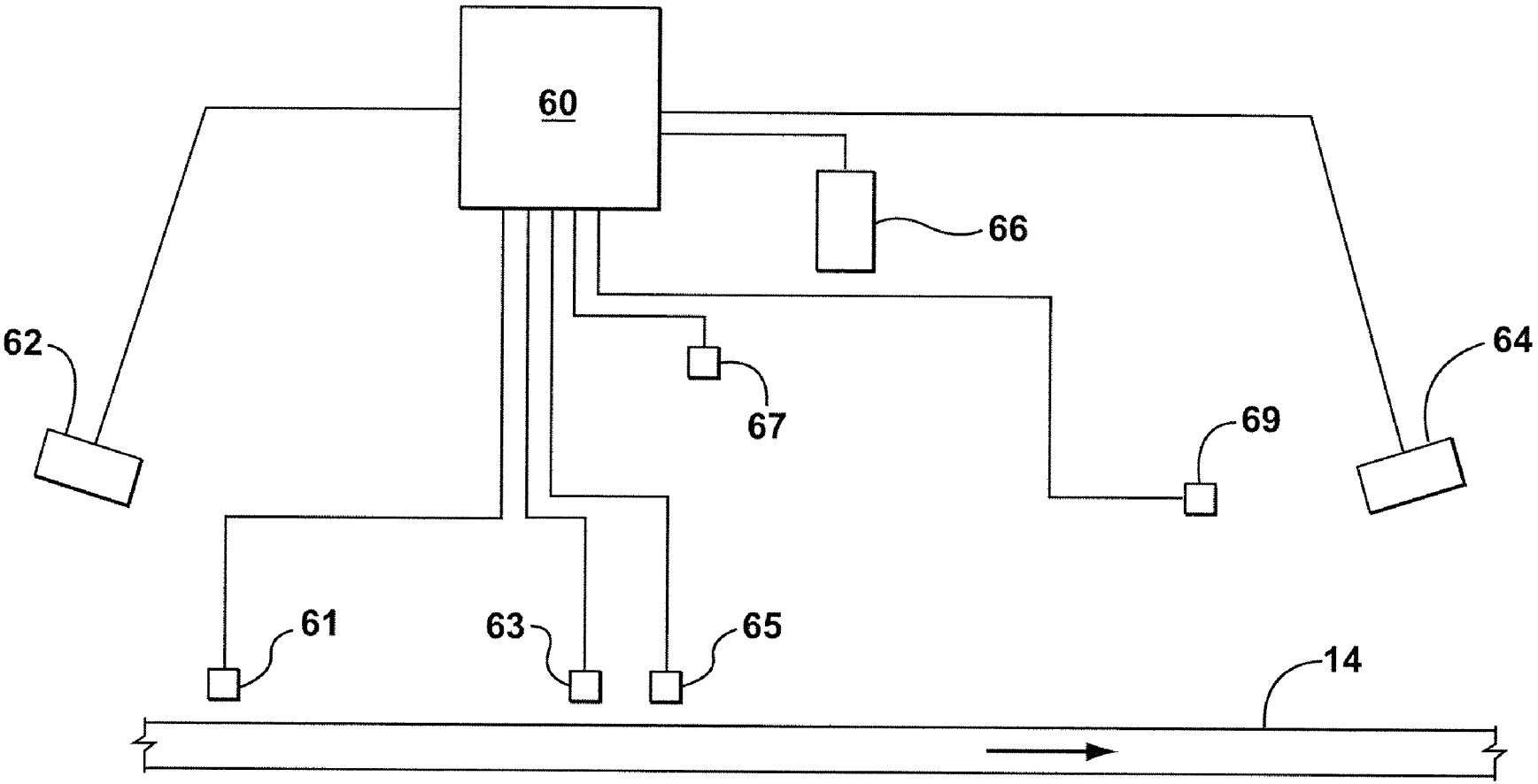
FIG. 6 is a block diagram schematically illustrating a portion of the apparatus of FIG. 2.

Turning to FIG. 6, a controller 60 outputs to a drive 62 for pusher 34, a drive 64 for pusher 54, and control valves 66 for cylinder 33. The controller receives an input from a flight sensor 61, a trailing sensor 63, and a leading sensor 65 associated with the conveyor 14. The controller also receives an input from a block sensor 67 and an insert pusher sensor 69.

Figure 7:
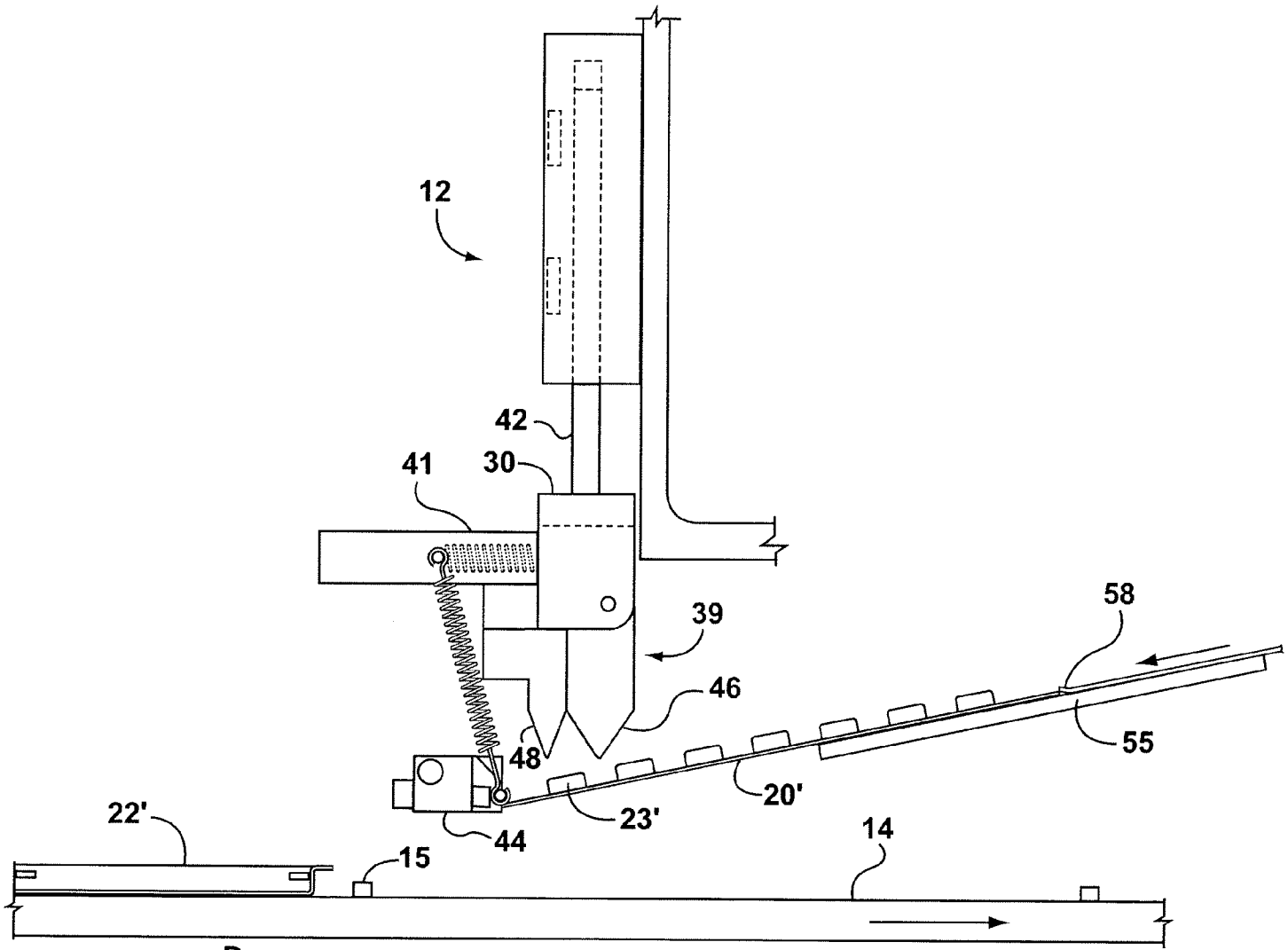
FIGS. 7 to 10 are partially fragmented side views of a portion of the apparatus of FIG. 2 illustrating operation of the apparatus.

Referencing FIGS. 5, 6, and 7, in operation, the controller 60 loads a blister pack 20 to the insertion station 11 by controlling drive 64 to extend pusher 54. This results in the upturned finger 58 pushing against the back edge of the bottommost blister pack 20' of the stack of blister packs in hopper 52. The frictional engagement of the blister pack 20' with the stack resists this pushing to cause the back edge of the bottom blister pack 20' to wedge between the upturned finger 58 and platform 55 as the blister pack 20' is pushed from the stack. The pusher 54 continues to push the blister pack 20' toward the insertion station 11 until the front edge of the blister pack 20' contacts the catch 44. Notably platform 55 of the pusher 54, which underlies the back portion of the blister pack 20', in combination with the fact that the back edge of the blister pack 20' is wedged between the upturned finger 58 and the platform 55, ensure the blister pack 20' remains in place on the platform 55 while traveling toward the catch 44. Further, because the blister pack 20' is self-supporting, it maintains a flat configuration even though only its rear portion is supported as it travels toward catch 44. FIG. 7 illustrates blister pack 20' loaded at the insertion station 11.

The flight sensor 61 signals the controller whenever a crosspiece 15 passes the sensor 61. This prompts the controller 60 to control the drive 62 to dispense a compact 22 onto conveyor 14 between crosspieces 15. The trailing sensor 63 signals the controller 60 when it senses the leading edge of a compact 22'. This causes the controller 60 to control the valves 66 so that the block 39 descends. In consequence, the fingers 46 and 48 impact the blister pack 20' on either side of a row 23' of blisters. This bends the front portion of the blister pack 20' downwardly, pushing the front edge of the blister pack 20' off catch 44. The fingers 46 and 48 continue to push the front edge of the blister pack 20' down while the compact 22' advances on conveyor 14 and its leading end moves under the fingers. At this point, as shown in FIG. 8, the front edge of the blister pack 20' is pushed into the leading end of compact 22' and against the bottom surface of the compact 22'.

Figure 8:
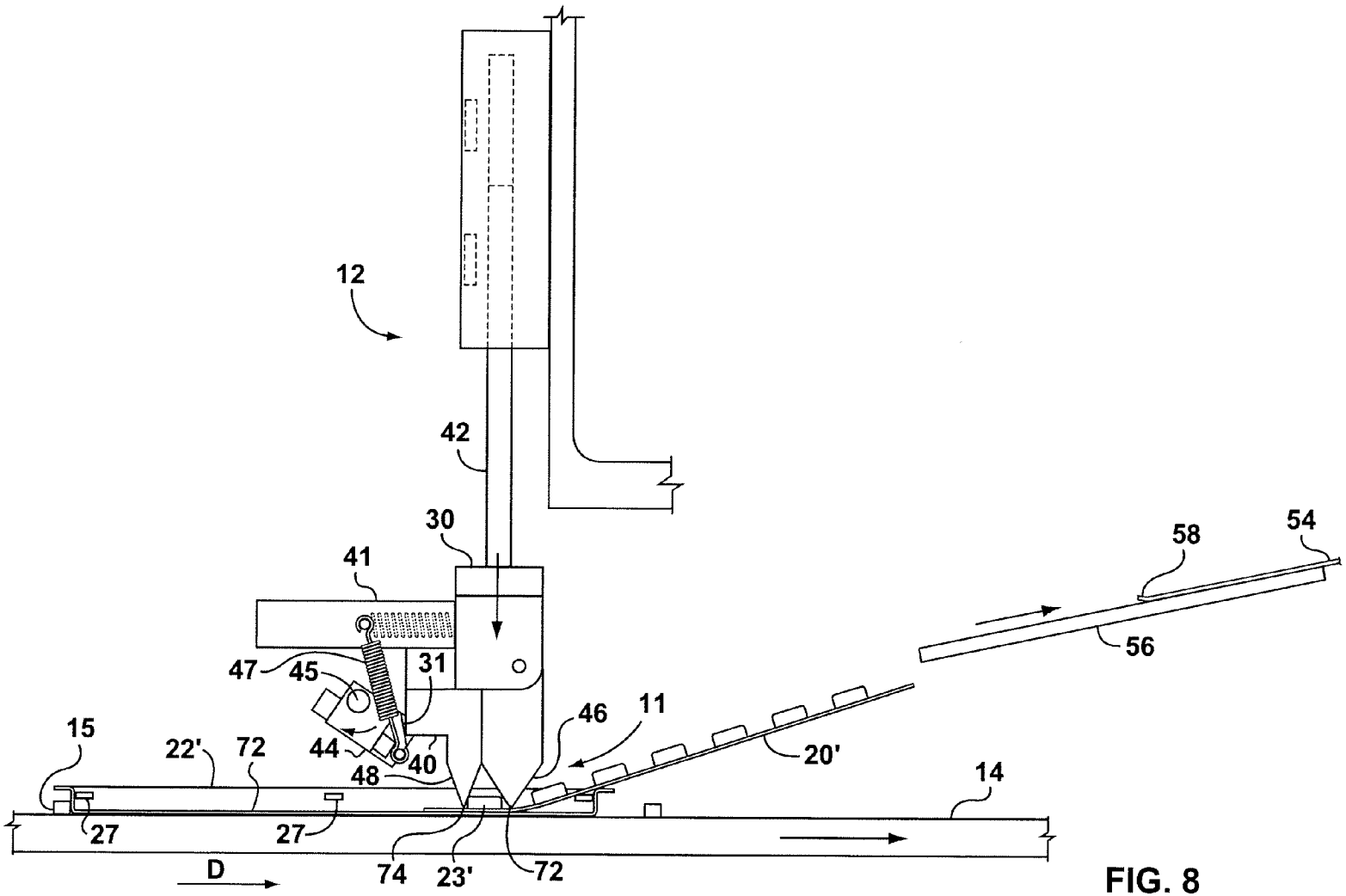

As the block 39 descends, spring 47 is relieved and, as seen in FIG. 8, the abutment 40 pushes the catch 44 out of the way.

The block sensor 67 signals the controller 60 when the block 39 reaches the bottom of its stroke. This prompts the controller 60 to control drive 64 to retract pusher 54. The blister pack 20' is trapped between the fingers 46 and 48 and the compact 22' and, with the fingers 46, 48 on either side of the row of blisters 23', the blister pack 20' is restrained against moving in the downstream direction. Consequently, with the pusher 54 withdrawing, the back edge of the blister pack 20' will first pull out from between the upturned finger 58 and platform 55 of the pusher 54 and then the back portion of the blister pack 20' will fall off the platform 55. Further, because the blister pack 20' is restrained from downstream movement, it will slide along the bottom surface of the compact 22' as the compact 22' advances downstream and will slide under the side tabs 27 of the compact 22'.

Figure 9:
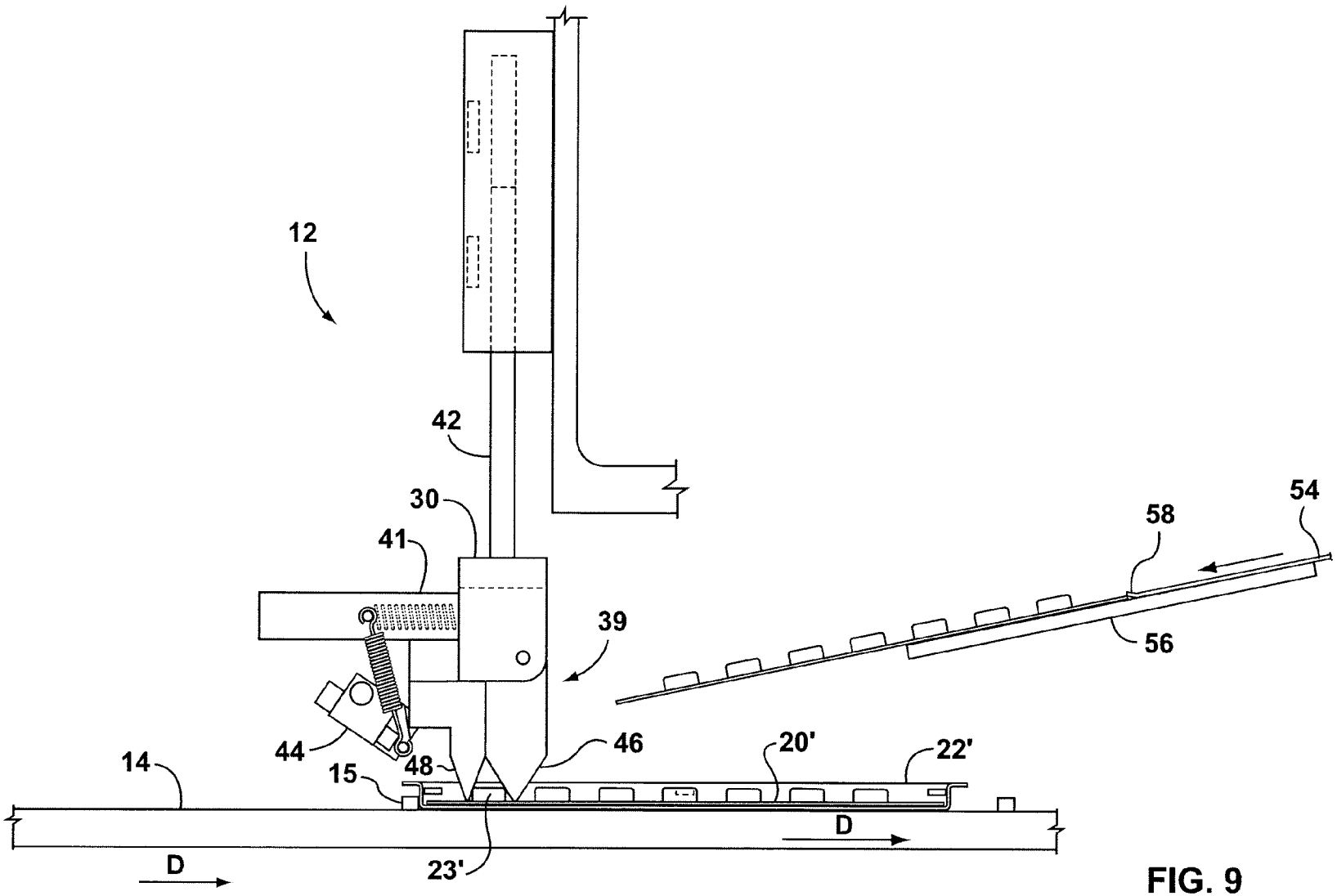

The natural resilience of the blister pack 20' causes it to try to straighten out. Consequently, when the rear edge of the blister pack 20' clears the leading side wall of the compact 22', the blister pack 20' straightens out at the bottom of the compact 22', as seen in FIG. 9.

As soon as insert pusher 54 returns to its retracted position, the new bottommost insert 20 is in position to be pushed from the insert hopper 52. The insert pusher sensor 69 signals the controller 60 once insert pusher 54 returns to its retracted position so that the controller 60 is prompted to control drive 64 to advance pusher 54 once more. As seen in FIG. 9, at the stage where blister pack 20' has been fully inserted into compact 22', controller 60 is already controlling pusher 54 to push the next blister pack 22 toward the insertion station 11.

Figure 10:
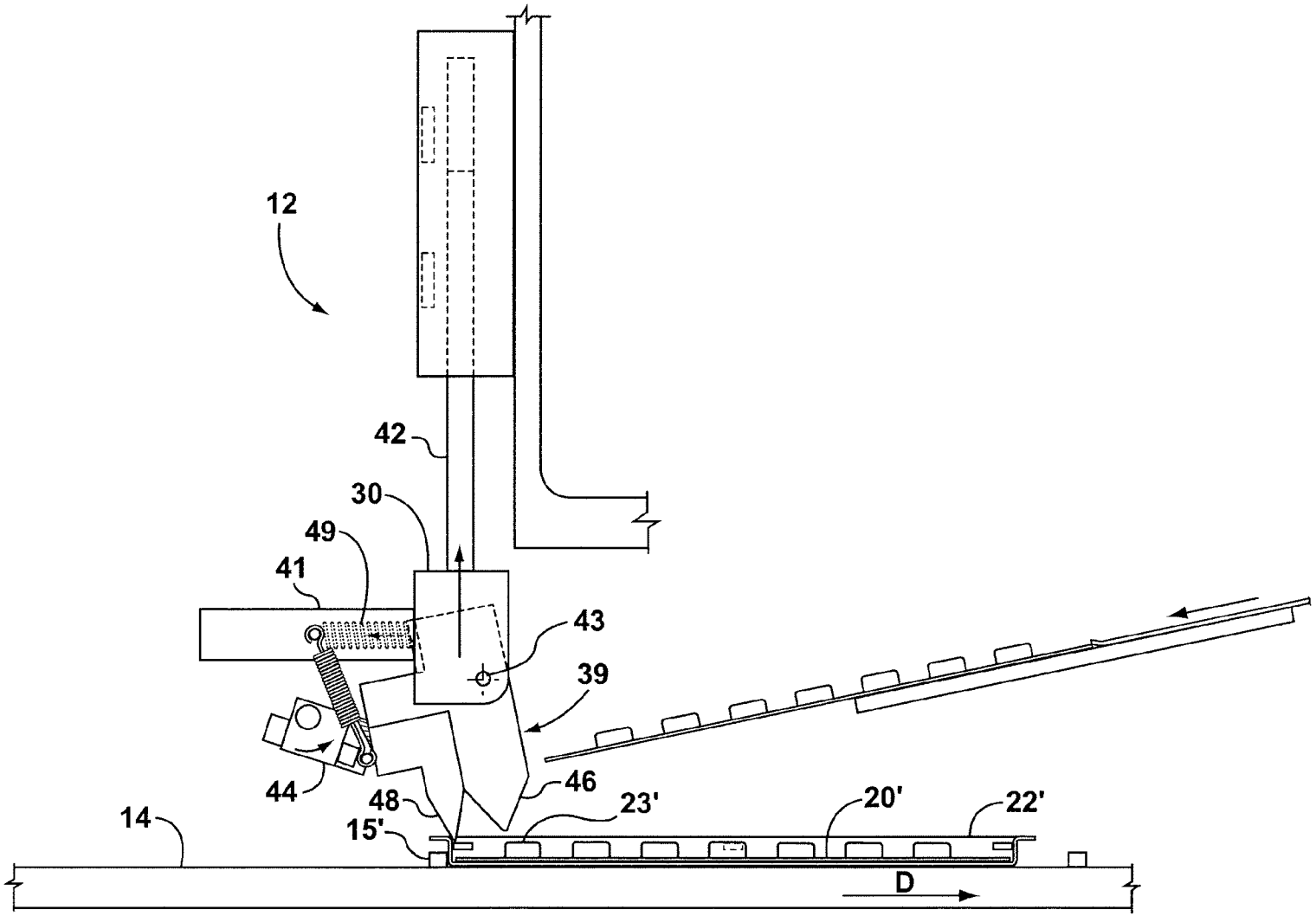

The leading sensor 65 signals the controller 60 when it senses the trailing edge of compact 22'. The leading sensor 65 is positioned on the conveyor 14 so that it senses the trailing edge of compact 22' at the stage when the blister pack 20' is fully inserted into the compact 22'. The signal from leading sensor 65 prompts the controller 60 to begin retracting block 39. As block 39 is retracting, likely the trailing side wall of the compact 22' will hit the block 39. As shown in FIG. 10, in this situation, the pivotal connection 43 of the block 39 to the piston 42 allows the block 39 to rotate against the urging of spring 49 until the block 39 clears the trailing side wall of the compact 22'. Once the block 39 clears the compact side wall, spring 49 returns the block 39 to its rest position. As the block 39 further retracts, abutment 40 pulls away from catch 44 so that the catch 44 also returns to its rest position under the urging of spring 47. The next blister pack 20 then has a clear path to be loaded to insertion station 11 so that the process can repeat.

Referencing FIGS. 1 and 3, the living hinge 28 tends to give the compact 22 a natural 'V' shape when open. This may be accommodated by giving the bottom of container hopper 32 a corresponding V shape and giving pusher 34 a V-shaped end. Further, conveyor 14 may support the compact such that the container 26 is flat on the conveyor and the cover 24 is inclined.

While not preferred, it may be possible to modify apparatus 10 so that it omits guide finger 48.

While apparatus 10 has been described for use in inserting blister packs into compacts, it may be possible to utilize apparatus 10 to insert certain other types of inserts into other types of open top containers. More specifically, it may be possible to use apparatus 10 with an insert having an upwardly projecting protuberance where pusher finger 46 could push against the insert downstream of the protuberance.

Other modifications will be apparent to those skilled in the art and, therefore, the invention is defined in the claims.

What is claimed is:

1. A method of inserting an insert having an upwardly projecting protuberance proximate one end into an open container comprising:

conveying said open container continuously in a downstream direction with a container conveyor with said container opening upwardly;

holding said insert above said conveyor at an insertion station by supporting a downstream portion of said insert, with said one end of said insert being the upstream end of said insert;

driving a pusher finger downwardly against an upstream portion of said insert at a downstream side of said protuberance in order to push said upstream portion of said insert downwardly into said container;

holding said upstream portion of said insert against an inside surface of said container with said pusher finger while said container is conveyed underneath said insert and simultaneously ceasing to support said downstream portion of said insert, said pusher finger abutting said downstream side of said protuberance to overcome frictional engagement between said insert and said container as said container is conveyed underneath said insert; and retracting said pusher finger.

2. The method of claim 1 wherein said retracting said pusher finger comprises retracting said pusher finger as the upstream end of said insert reaches a trailing side wall of said container.

3. The method of claim 2, further comprising:

While retracting said pusher finger, allowing said pusher finger to pivot away from a rest position when said trailing side wall of the upstream end of said container pushes said pusher finger downstream.

4. The method of claim 3, further comprising biasing said pusher finger toward said rest position.

5. The method of claim 1, further comprising:

prior to holding said insert above said conveyor, pushing said insert upstream into abutment with a catch member.

6. The method of claim 5, further comprising:

while driving said pusher finger, rotating said catch member from a catch position whereat said catch member supports said upstream end of said insert, to a release position whereat said catch member clears said upstream end of said insert.

7. The method of claim 6, further comprising:

while retracting said pusher finger, rotating said catch member from said release position to said catch position.

8. The method of claim 6, wherein rotating said catch member from said catch position to said release position comprises driving an abutment downwardly into a portion of an angled cam face of said catch member, said portion of said angled cam face being downstream of a pivot point at which said catch member is pivotally connected.

9. The method of claim 8, wherein said abutment is rigidly connected to said pusher finger.

10. The method of claim 8, wherein said catch member is biased toward said catch position.

11. The method of claim 1, wherein said upstream portion of said insert is a first upstream portion, said method further comprising:

while driving said pusher finger, driving a guide finger downwardly against a second upstream portion of said insert at an upstream side of said protuberance, said second upstream position being proximate the upstream edge of said insert;

holding said second upstream portion of said insert against said container with said guide finger while said container is conveyed underneath said insert;

while retracting said pusher finger, retracting said guide finger.

12. The method of claim 11, wherein said guide finger is rigidly connected to said pusher finger.

13. The method of claim 11, wherein said container comprises a plurality of laterally spaced, inwardly projecting tabs, with a respective channel being formed between each one of said tabs and an inner bottom surface of said container, said inserting of said insert into said container causing an outside edge of said insert to slide into at least one of said channels.

* * * * *